US007497268B1

(12) United States Patent
Zeni

(10) Patent No.: US 7,497,268 B1
(45) Date of Patent: Mar. 3, 2009

(54) DRILL PIPE ELEVATORS AND METHODS OF MOVING DRILL PIPE

(75) Inventor: John Zeni, Sheridan, WY (US)

(73) Assignee: Rock Well Petroleum Inc., Sheridan, WY (US)

( * ) Notice: Subject to any disclaimer, the term of this patent is extended or adjusted under 35 U.S.C. 154(b) by 0 days.

(21) Appl. No.: 11/924,168

(22) Filed: Oct. 25, 2007

(51) Int. Cl.
*E21B 23/00* (2006.01)
*E21B 19/18* (2006.01)
*E21B 19/06* (2006.01)

(52) U.S. Cl. ..... 166/381; 166/379; 166/382; 166/77.52; 294/102.2; 294/90; 294/91

(58) Field of Classification Search ..... 166/379, 166/382, 77.52, 381; 294/102.2, 90, 91, 294/86.29, 113, 86.33, 88
See application file for complete search history.

(56) References Cited

U.S. PATENT DOCUMENTS 1,795,578 A * 3/1931 Smith ..... 188/67
5,375,897 A 12/1994 Gazel-Anthoine
7,044,216 B2 * 5/2006 Otten et al. ..... 166/77.52
7,303,021 B2 * 12/2007 Schats et al. ..... 166/379

* cited by examiner

*Primary Examiner*—Jennifer H Gay
*Assistant Examiner*—Yong-Suk Ro
(74) *Attorney, Agent, or Firm*—WElls St. John P.S.

(57) ABSTRACT

A drill pipe elevator includes first and second separable pieces. Each piece comprises a drill pipe-receiving groove, and a pair of diametrically opposed projections with each projection forming only part of a pair of diametrically opposed lifting posts. The first and second separable pieces when positioned together define the pair of diametrically opposed lifting posts from the pair of diametrically opposed projections and define a drill pipe-receiving passageway through the drill pipe elevator that is oriented transversely between the lifting posts.

41 Claims, 8 Drawing Sheets

DRILL PIPE ELEVATORS AND METHODS OF MOVING DRILL PIPE

TECHNICAL FIELD

This invention relates to drill pipe elevators and to methods of moving drill pipe.

BACKGROUND OF THE INVENTION

When drilling wells into the earth, a string of drill pipe is rotated and driven into the earth to form the hole or well through which the fluid will be extracted to the surface. The end of the string of drill pipe includes a cutting head which dislodges the earthen material as the drill pipe string is driven deeper into the earth. Water is typically flowed into the well being drilled, with the water and removed earthen material flowing upwardly around or within the rotating drill pipe and outwardly of the well being drilled.

The drill pipe string is made up of a plurality of pipe segments which are connected end-to-end. The drill string is rotated and advanced into the earth until another segment of drill pipe is needed to extend the assembled length of drill pipe segments further. Then, the rotation of the drill string is stopped and the device imparting the rotary motion to the drill string is moved out of the way to enable another segment of drill pipe to be secured to the drill string. Further at the conclusion of drilling, the process is reversed whereby the drill string must be raised with each segment of drill pipe being sequentially removed as it exits the well.

The mechanism which is used to grasp a segment of drill pipe, whether separate from or attached to the drill string, is commonly known as a drill pipe elevator. Such are typically hinged, clam-shell devices which can be opened to be received about a segment of drill pipe and subsequently closed to be clasped about an upper end of the drill pipe segment. The drill pipe segments typically have projecting flanges at their ends or diametrically enlarged neck portions at an outer end thereof which prevents the drill pipe from sliding through the drill pipe elevator. The drill pipe elevator typically includes diametrically opposed rings which can be grasped by cables, hooks, links, or bails of an elevator mechanism for raising and lowering the drill pipe elevator and correspondingly a drill pipe segment, including an entire drill string, received thereby.

SUMMARY

This invention comprises drill pipe elevators and methods of moving drill pipe. In one implementation, a drill pipe elevator includes first and second separable pieces. Each piece comprises a drill pipe-receiving groove, and a pair of diametrically opposed projections with each projection forming only part of one of a pair of diametrically opposed lifting posts. The first and second separable pieces when positioned together define the pair of diametrically opposed lifting posts from the pair of diametrically opposed projections and define a drill pipe-receiving passageway through the drill pipe elevator that is oriented transversely between the lifting posts.

In one implementation, a method of moving drill pipe includes providing a drill pipe elevator comprising first and second separable pieces, where each piece comprises a drill pipe-receiving groove and a pair of diametrically opposed projections with each projection forming only part of one of a pair of diametrically opposed lifting posts. The first and second separable pieces when positioned together define the pair of diametrically opposed lifting posts from the pair of diametrically opposed projections and define a drill pipe-receiving passageway through the drill pipe elevator that is oriented transversely between the lifting posts. One of the first and second pieces and a drill pipe are positioned relative one another such that the drill pipe is received within the drill pipe-receiving groove of the one piece. During or after the positioning, the other of the first and second pieces is moved to position its well-pipe receiving groove facing the drill pipe opposite the one piece to define the pair of diametrically opposed lifting posts. An elevator mechanism is engaged about at least a portion of each of the lifting posts. The drill pipe is raised or lowered by the lifting posts with the elevator mechanism.

Other aspects and implementations are contemplated.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
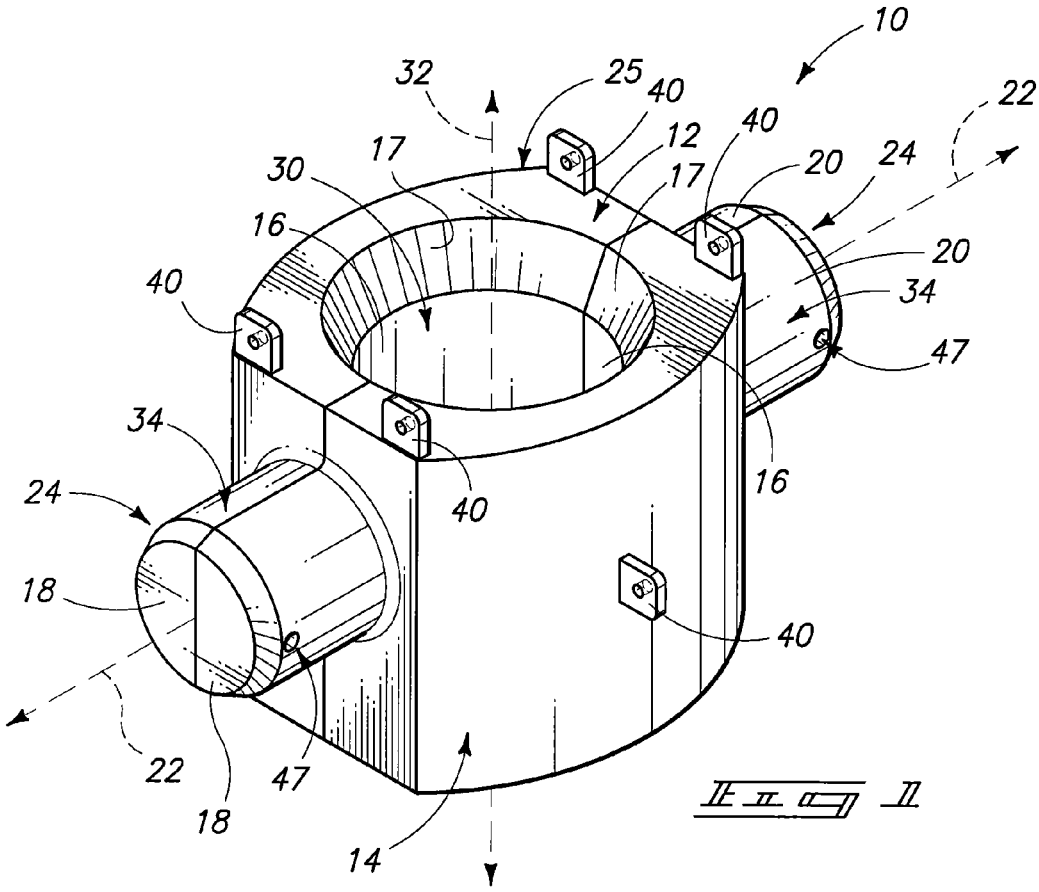
FIG. 1 is a perspective view of a drill pipe elevator in accordance with an embodiment of the invention.
Figure 2:
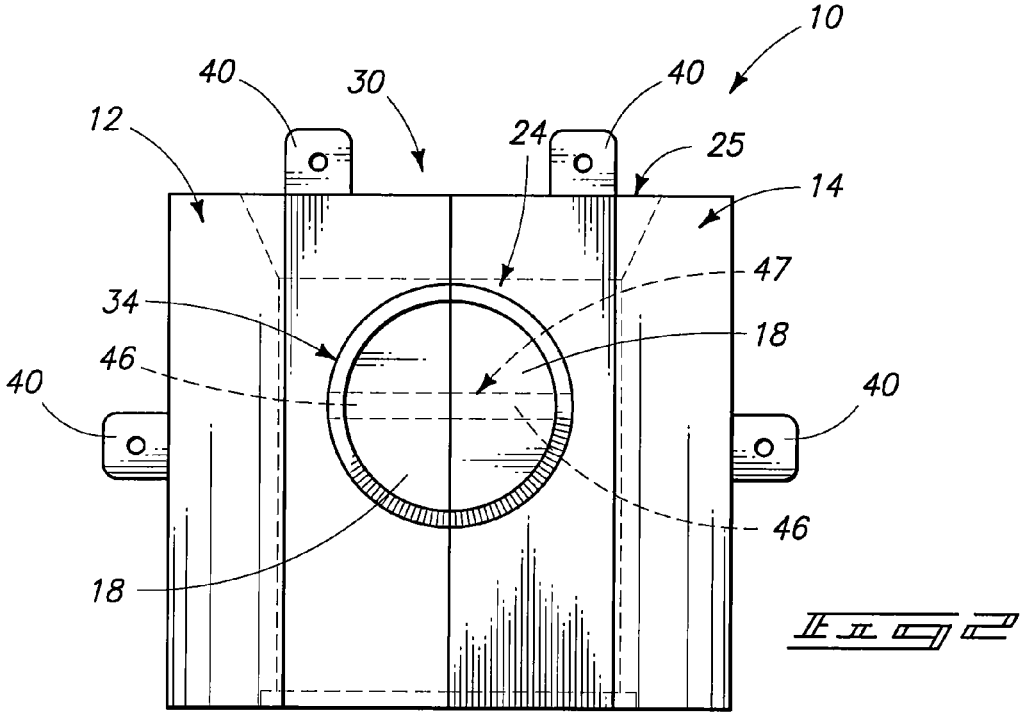
FIG. 2 is an end view of the drill pipe elevator of FIG. 1.
Figure 3:
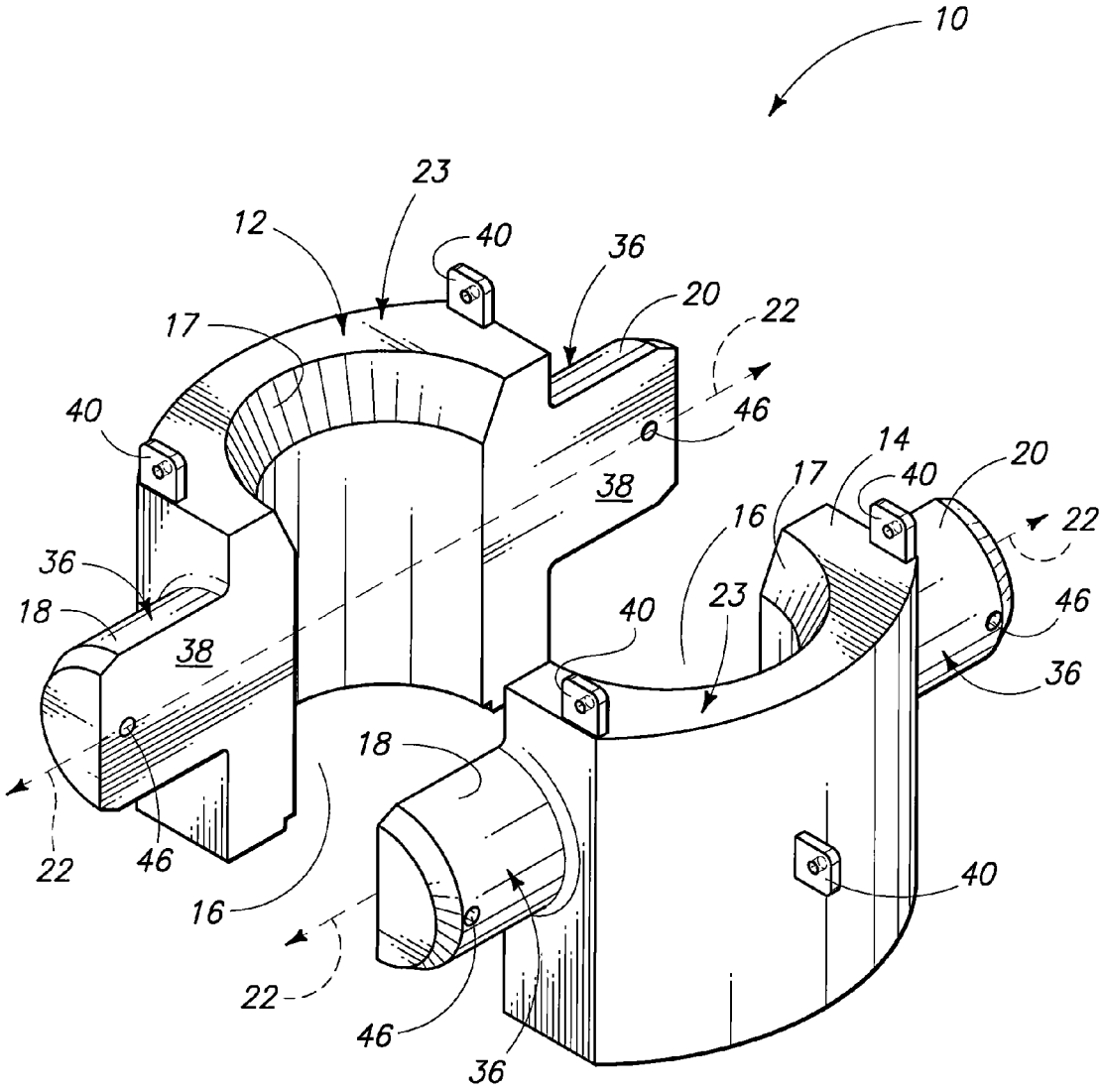
FIG. 3 is another perspective view of the drill pipe elevator of FIG. 1.
Figure 4:
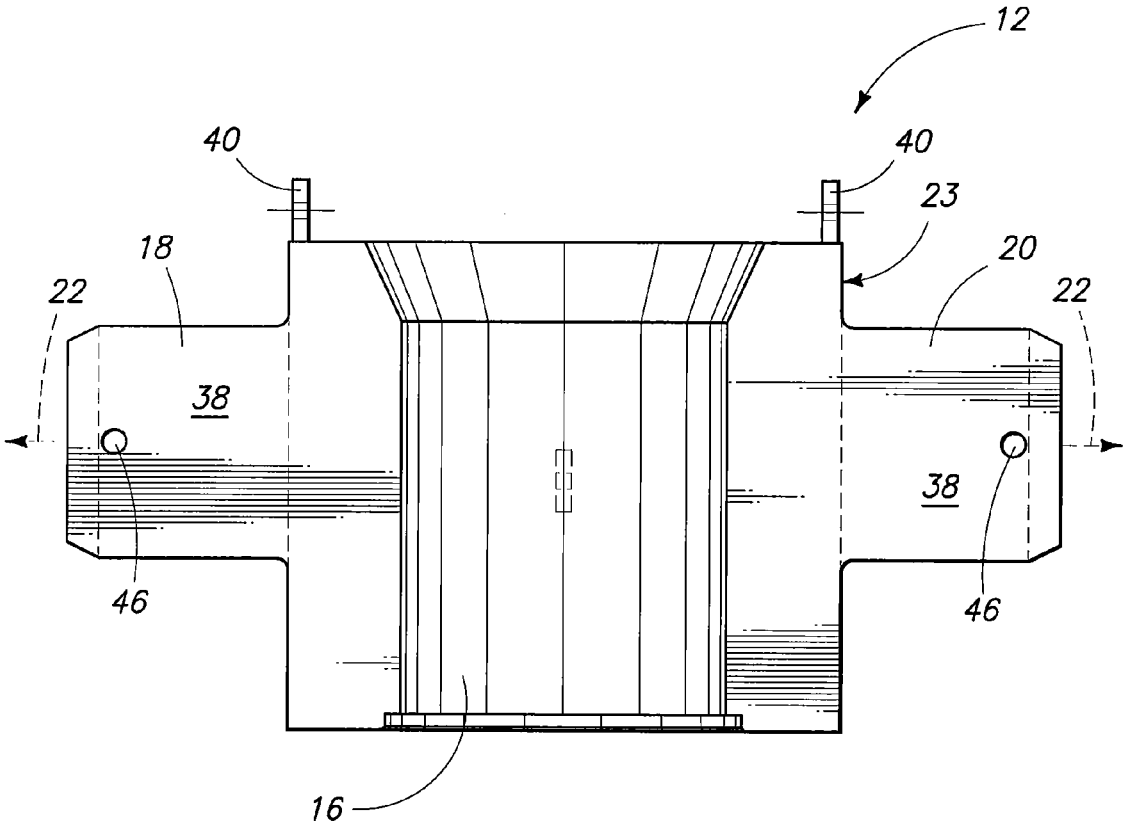
FIG. 4 is a side elevation view of one piece of the drill pipe elevator of FIG. 1.
Figure 5:
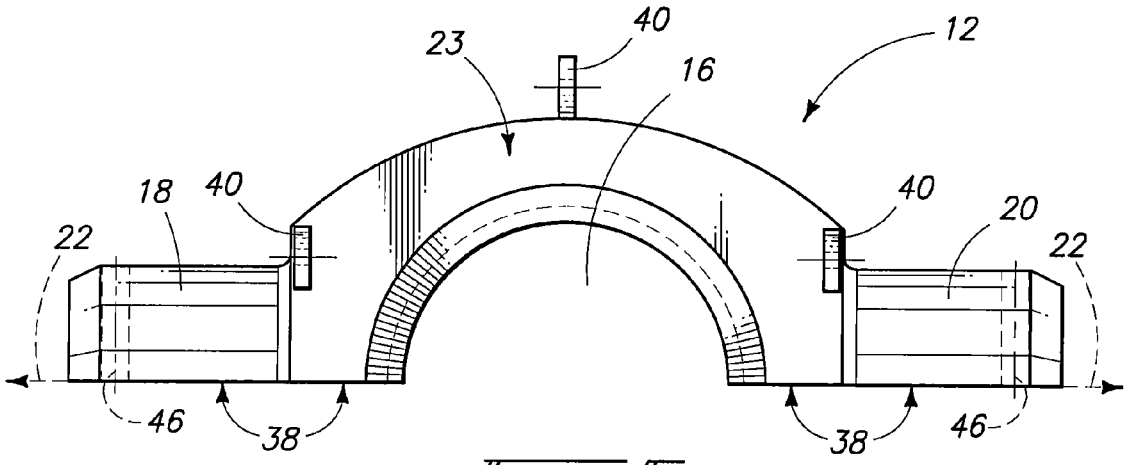
FIG. 5 is a top down view of the FIG. 4 piece.
Figure 6:
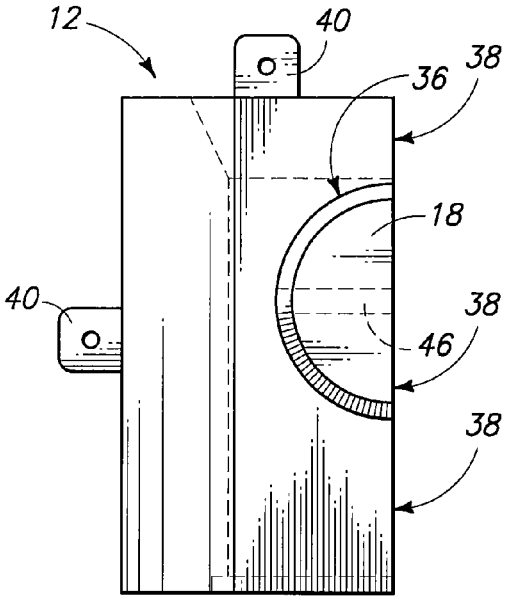
FIG. 6 is an end view of the FIG. 4 piece.

Referring to FIGS. 1-3, a drill pipe elevator in accordance with an embodiment of the invention is indicated generally with reference numeral 10. Referring to FIGS. 1-6, drill pipe elevator 10 comprises first and second separable pieces 12 and 14. In one preferred embodiment, and as shown, first and second separable pieces 12, 14 are identically shaped relative to one another, although alternate configurations and differing respective shapes are also of course contemplated. Regardless, each piece 12, 14 comprises a drill pipe-receiving groove 16 and a pair of diametrically opposed projections 18 and 20. Each projection 18, 20 projects along a line or direction 22 relative to a primary or main body portion 23 of each separable piece. Drill pipe-receiving groove 16 may comprise an upwardly outwardly flared or tapered section 17, for example to receive an outwardly flared portion of a drill pipe for which elevator 10 is adapted to receive. Further, the drill pipe-receiving groove may comprise any shape to accommodate receiving any particular segment of drill pipe.

Each projection 18, 20 is sized and shaped to form only part of a one of a pair of diametrically opposed lifting posts when the first and second pieces are positioned together in an operable manner. For example, FIGS. 1 and 2 depict first and second pieces 12 and 14 so positioned together to define a pair of diametrically opposed lifting posts 24 from the pair of diametrically opposed projections 18, 20 which project outwardly along directions 22 relative to a primary or main body section 25 (FIGS. 1 and 2) of drill pipe elevator 10. Further when so positioned, first and second pieces 12, 14 define a drill pipe-receiving passageway 30 extending through drill pipe elevator 10 that is oriented in a transverse direction 32 (FIG. 1) between lifting posts 24. In the depicted and preferred embodiment, each pair of lifting posts 24 has a circular periphery 34 in a plane which is transverse direction 22 in which the respective lifting posts 24 project. Alternate shaped peripheries are also of course contemplated, with circular nevertheless being one preferred embodiment. Further in the depicted embodiment, each respective projection 18, 20 of each separable piece 12, 14 forms half of one of the pair of lifting posts 24, and in one embodiment each projection 18, 20 has a periphery 36 (FIGS. 3 and 6) in a plane transverse a direction in which the respective projection projects (i.e., direction 22) which forms a half circle.

Each of first and second pieces 12, 14 comprises surfaces 38 which contact surfaces of the other of the first and second piece. In the depicted example embodiment, contacting surfaces 38 are received on both the primary or main body portion 23 of each separable piece as well as comprising a portion of each projection 18, 20, respectively. In one preferred embodiment, all of such contacting surfaces 38 are flat, and also the contacting surfaces of each piece lie in a respective common plane. Alternate configurations might include curved contacting surfaces and/or male/female contacting surface grooves and projections. Each separable piece 12 and 14 is depicted as comprising example lifting projections or clevises 40 having holes there-through for lifting and moving each separable piece relative one another and/or a drill pipe segment about which elevator mechanism 10 would be received in operation. Example materials of construction for pieces 12 and 14 include hardened steel, with each piece perhaps weighing in excess of 1,000 pounds and depending upon the size and configuration of the drill pipe with which drill pipe elevator 10 is adapted to work. In one preferred embodiment, first and second separable pieces 12, 14 are void of any hinged connection relative to one another when positioned together.

Figure 7:
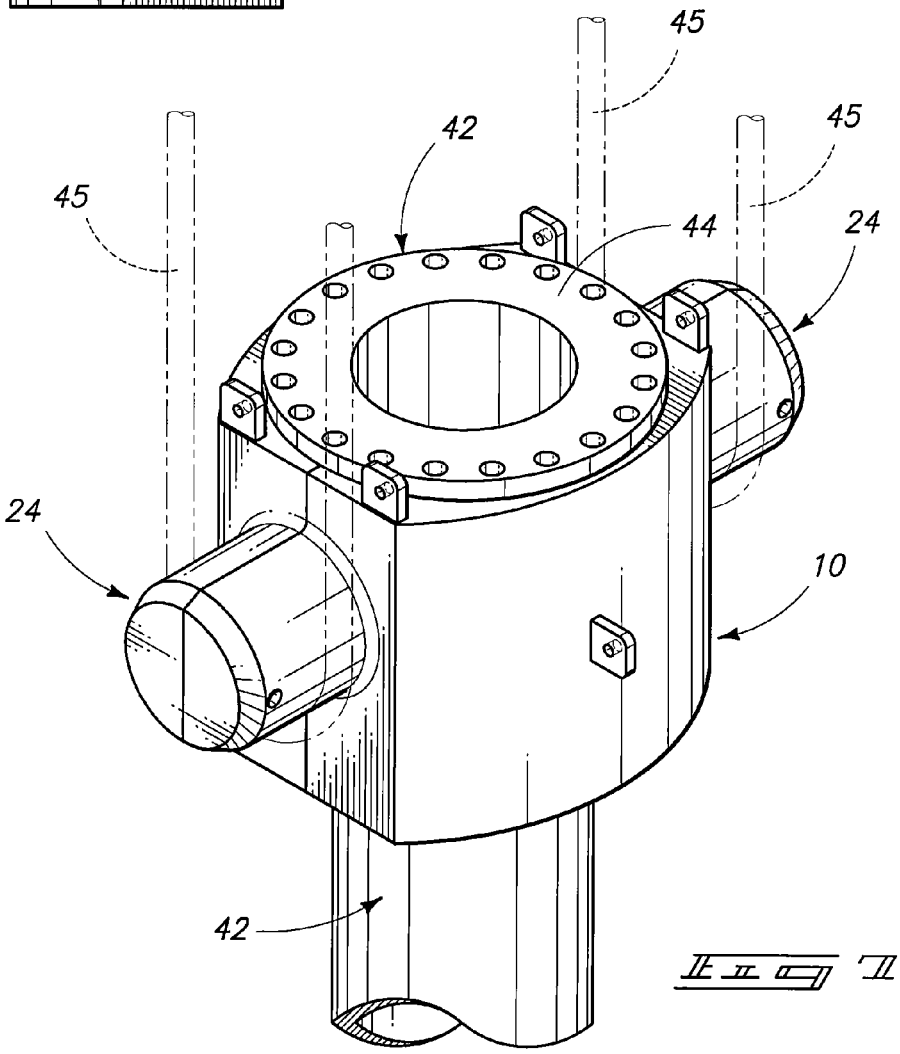
FIG. 7 is a perspective view of the FIG. 1 drill pipe elevator in one operational configuration.

Lifting posts 24 are configured for use with a suitable elevator mechanism for moving drill pipe elevator 10 and raising or lowering a drill pipe received thereby. For example, FIG. 7 depicts a drill pipe 42 received by drill pipe elevator 10. Drill pipe 42 extends through drill pipe-receiving passageway 30 in drill pipe elevator 10, and comprises a radially projecting flange 44 which bears against an upper surface of drill pipe elevator 10 for moving drill pipe 42 with drill pipe elevator 10. Alternate drill pipe configurations are also of course contemplated as long as drill pipe elevator 10 can be received about the drill pipe for raising and lowering the drill pipe within a well bore and moving drill pipe segments externally of a well bore.

FIG. 7 also depicts an elevator mechanism engaging about at least a portion of each of lifting posts 24. By way of example only in the depicted embodiment, such comprises wire rope 45 which extends at least partially about each lifting post 24. Accordingly, wire rope 45 can be used to raise and lower drill pipe 42 by drill pipe elevator 10. Further, the exemplary preferred circular periphery of each projection 24 facilitates sliding pivoting action of each projection 24 relative to wire rope 45, for example functioning much like a trunnion, when a drill pipe segment is being moved in other than a vertical orientation, or perhaps if swinging to some degree. Alternate elevator mechanisms are of course contemplated, and lifting posts 24 could be shaped or otherwise configured for use with any suitable elevator mechanism whether existing or yet-to-be developed.

In certain embodiments, a lifting mechanism retainer can be associated with each lifting post, with such retainer for example projecting transverse a direction in which the lifting post projects to be configured to block movement of a lifting mechanism (for example a wire rope 45 or other device) longitudinally from off of the respective lifting post. For example in one embodiment, and with reference to FIGS. 1-6, each projection 18, 20 comprises a hole 46 extending there-through transverse direction 22 in which the respective projection projects. Hole 46 in each of projections 18, 20 lines up with a hole 46 in another of the projections to define a hole 47 extending through each of lifting posts 24 when first and second separable pieces 12, 14, respectively, are positioned together.

Figure 8:
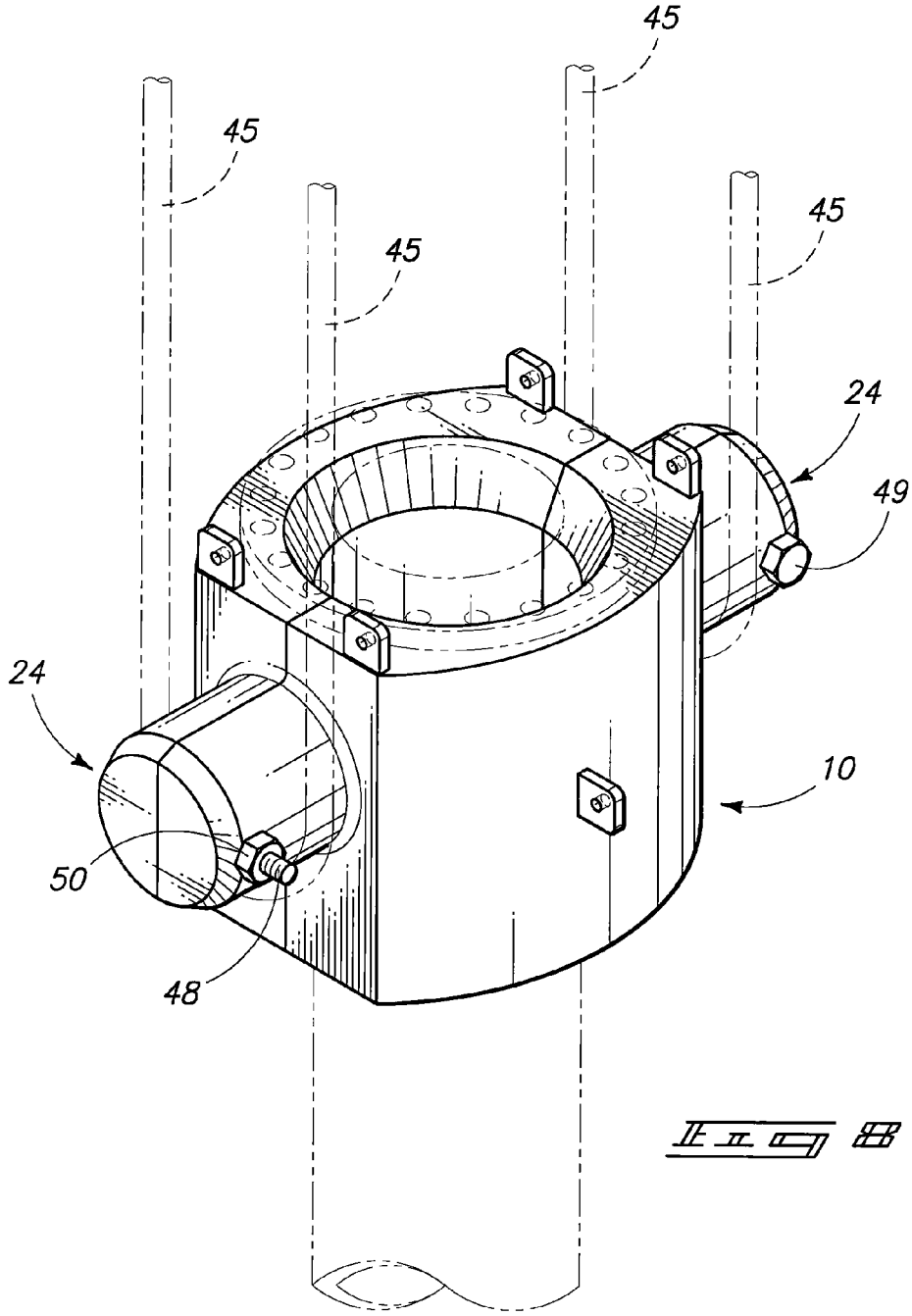
FIG. 8 is a perspective view of a drill pipe elevator in accordance with an embodiment of the invention.

Referring to FIG. 8, a suitable rod 48 is received through and projects outwardly of ends of hole 47 which extends through each of lifting posts 24. In one embodiment and as shown, rod 48 comprises a bolt having a nut 50 threaded thereto. FIG. 8, by way of example only, depicts bolt 48 and nut combinations 50 extending opposingly through the two projections 24 for purposes of illustration. Bolt 48 is depicted as comprising a head 49. For example, the size of head 49 and the length of bolt/rod 48 can be sized sufficiently great to be effective to preclude a lifting mechanism such as wire rope 45 from sliding longitudinally off of lifting posts 24 in operation.

Figure 9:
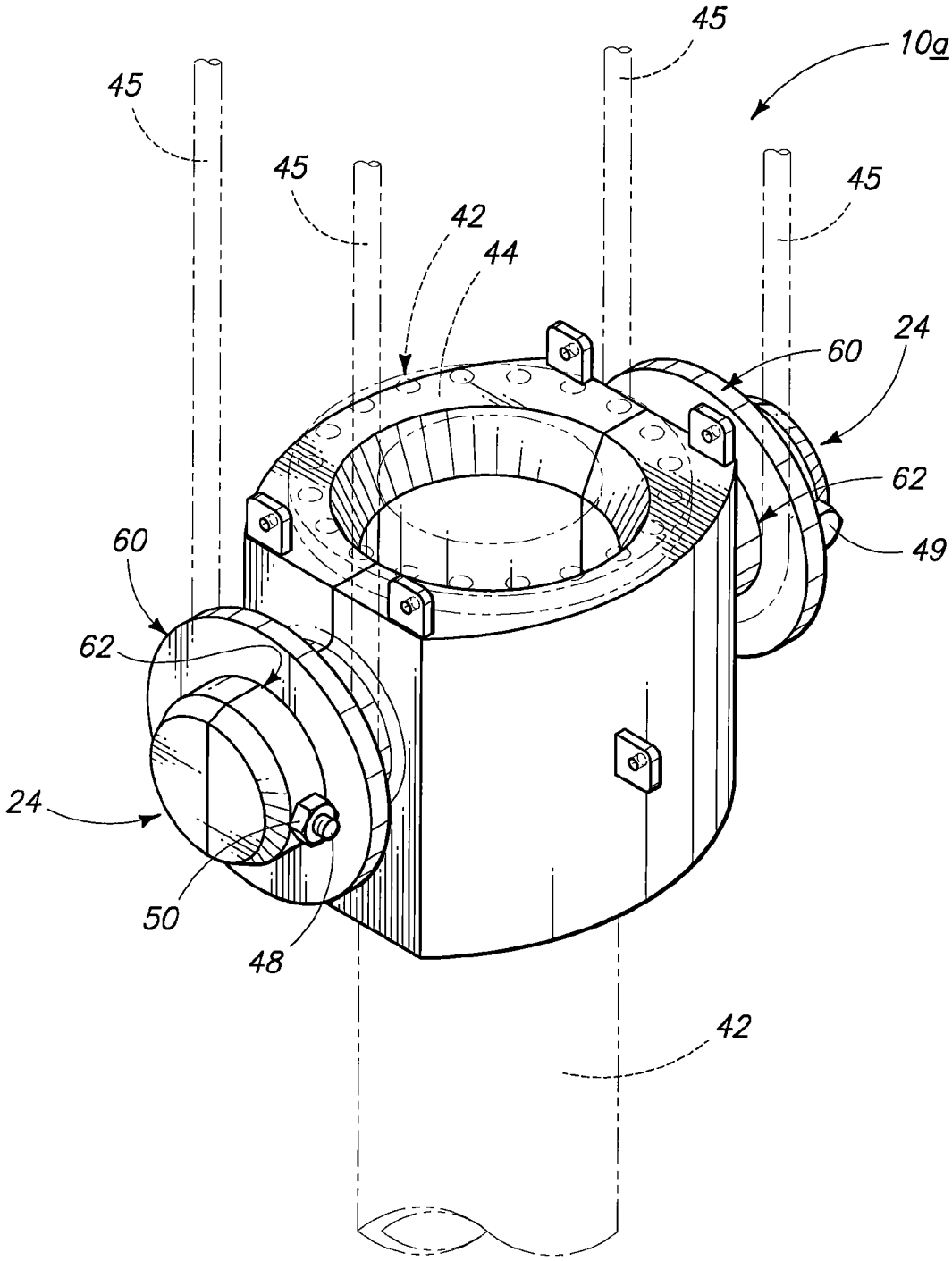
FIG. 9 is a perspective view of a drill pipe elevator in accordance with an embodiment of the invention.

A lifting mechanism retainer might further or alternately comprise additional configurations, for example in the form of an annulus received about the respective lifting posts. For example and by way of example only, outer longitudinal portions of lifting posts 24 might be shaped to have annularly/radially projecting portions (not shown) which would largely preclude outward sliding of a wire rope 45 from the lifting posts when moving the drill pipe elevator. FIG. 9 depicts an alternate example embodiment drill pipe elevator 10*a*. Like numerals from the first described embodiment are utilized where appropriate, with differences being indicated with the suffix "a" or with different numerals. Drill pipe elevator 10*a* is the same as drill pipe elevator 10 of FIG. 8 and additionally is depicted as comprising an annulus 60 received about each lifting post 24 which is in the form of a ring having an opening 62 therein of sufficient size to enable the annulus to be slid on and off the respective lifting post 24. Annulus 60 in the FIG. 9 example embodiment is washer-like in shape. To install such, first and second separable pieces would be positioned together as shown in FIGS. 1 and 2, with a drill pipe being received through drill pipe-receiving passageway 30 (the drill pipe not being shown in FIGS. 1 and 2). Rings 60 would then be slid over the respective lifting posts 24 inwardly past holes 47, and then the depicted nut and bolt combinations provided there-through to preclude ring 60 from sliding longitudinally off of the respective lifting posts 24. A lifting mechanism 45 in the form of a wire rope could be provided about lifting post 24 before or after positioning of ring 60. Further, if the lifting or other elevator mechanism cannot practically be provided to be received over the lifting post 24 after positioning of annulus 60, the lifting mechanism might be provided before the ring or other annulus 60 and before the depicted example nut and bolt retainer.

Figure 10:
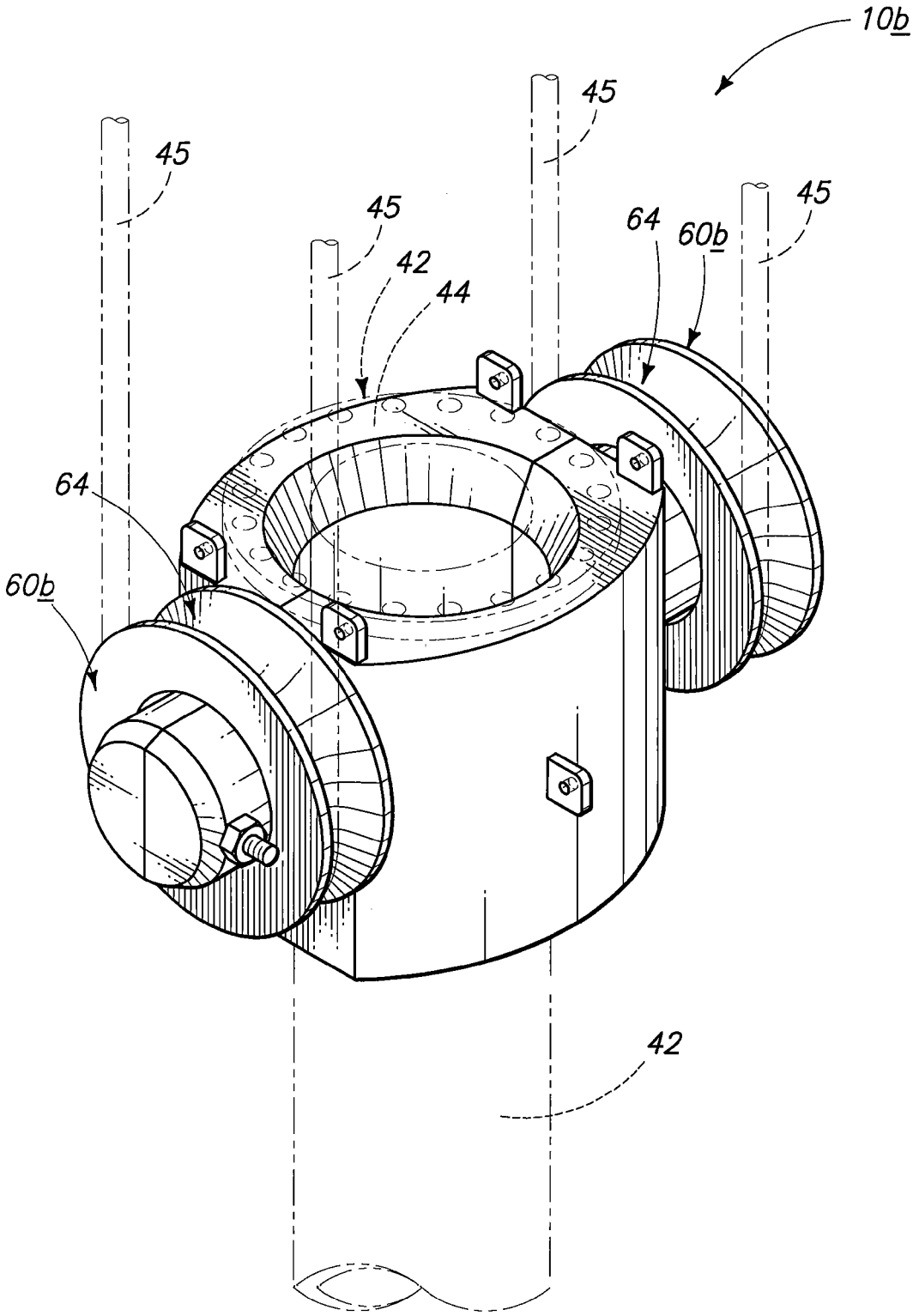
FIG. 10 is a perspective view of a drill pipe elevator in accordance with an embodiment of the invention.

FIG. 10 depicts another alternate embodiment drill pipe elevator 10*b*. Like numerals from the first described embodiment are utilized where appropriate, with differences being indicated with the suffix "b" or with different numerals. Drill pipe elevator 10*b* is the same as drill pipe elevator 10*a*, except having an alternate ring 60*b* in the form of a sheave. Such is depicted as comprising a groove 64 within which wire rope 45 can be received. A sheave 60*b* might also of course be utilizable with alternate lifting mechanisms which may not use a wire rope segment for engaging at lifting pins 24.

Figure 11:
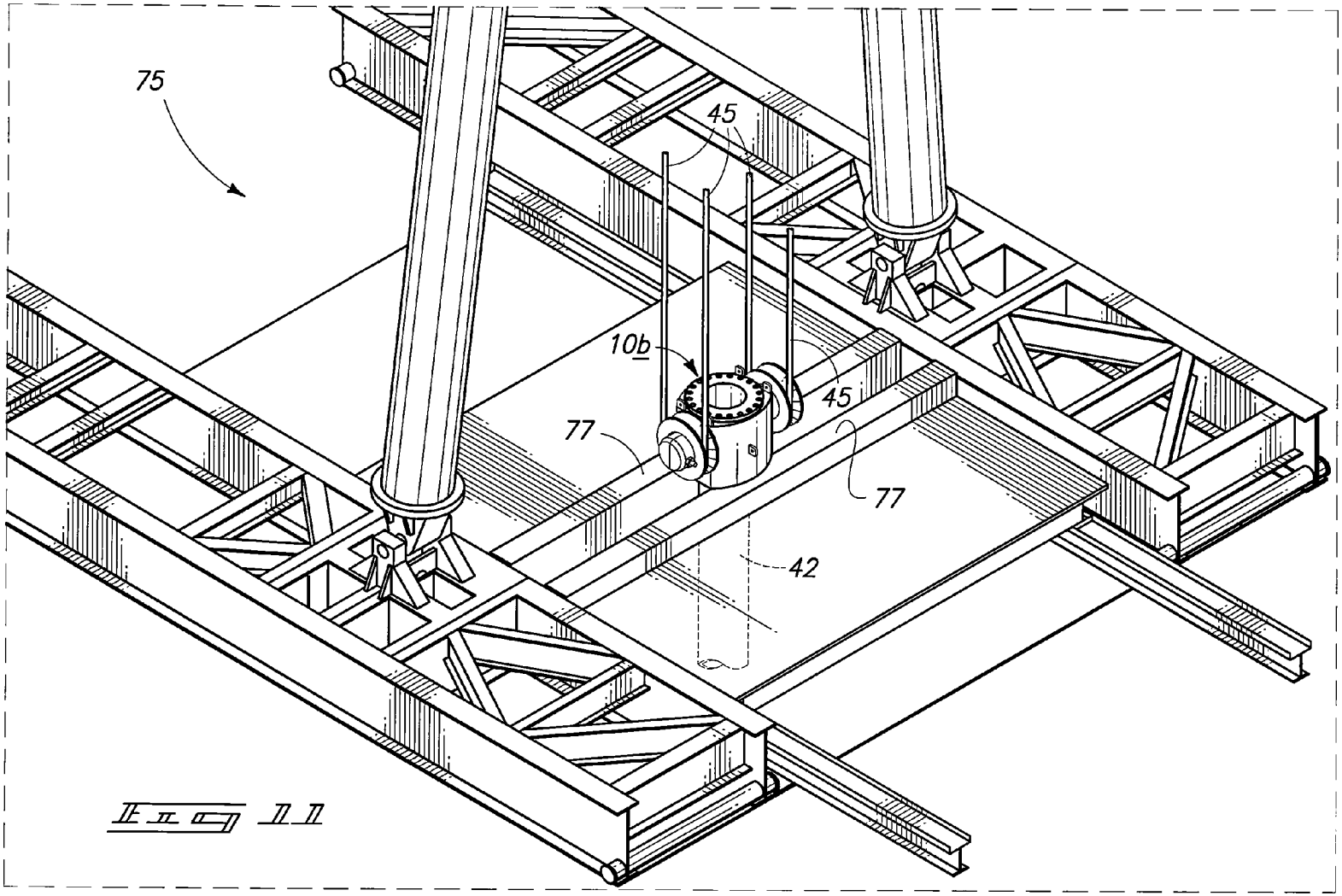
FIG. 11 is a perspective view of the FIG. 10 drill pipe elevator in one operational configuration.

Referring to FIG. 11, such depicts, by way of example only, drill pipe elevator 10*b* positioned relative to a drilling rig assembly 75. Drill pipe elevator 10*b* is shown as being elevationally supported from beneath by a pair of spaced projecting rails 77 and between and through which drill pipe segment 42 extends.

Aspects of the invention also encompass methods of moving drill pipe. In one embodiment, such a method encompasses providing a drill pipe elevator comprising first and second separable pieces, with each piece comprising a drill pipe-receiving groove and a pair of diametrically opposed projections and with each projection forming only part of one of a pair of diametrically opposed lifting posts. The first and second pieces when positioned together define the pair of diametrically opposed listing posts from the diametrically opposed projections and define a drill pipe-receiving passageway through the drill pipe elevator that is oriented transversely between the lifting posts. By way of example only, any of devices 10, 10*a*, and/or 10*b* comprises such an example drill pipe elevator.

One of the first and second pieces and a drill pipe are positioned relative one another such that the drill pipe is received within the drill pipe-receiving groove of the one piece. For example and by way of example only, one of the pieces could be laid on the ground with its drill pipe-receiving groove facing upwardly. A drill pipe could then be positioned to lay within the drill pipe-receiving groove of the one piece, for example substantially horizontally over the ground. Alternately, and by way of example only with respect to FIG. 11, a drill string could extend between rails 77 into a bore hole in a suitable manner whereby the drill string projects upwardly therefrom a suitable distance. One of pieces 12 or 14 could thereafter be positioned relative to the drill pipe such that the drill pipe is received within the drill pipe-receiving groove of the one piece.

Regardless, during or after the positioning, the other of the first and second pieces is moved to position its well-pipe receiving groove facing the drill pipe opposite the one piece to define the pair of diametrically opposed lifting posts. An elevator mechanism is ultimately engaged about at least a portion of each of the lifting posts. The drill pipe is then raised or lowered by the lifting post with the elevator mechanism.

In one embodiment, each projection comprises a hole extending there-through transverse a direction in which the projection projects, with the hole in each of the projections lining up with the hole in another of the projections to define a hole extending through each of the lifting posts after the positioning and the moving. A rod is provided through and projecting outwardly of ends of the hole extending through each of the lifting posts.

In one embodiment, a ring is slid over each of the lifting posts after the engaging of the elevator mechanism about at least a portion of each of the lifting posts. In one embodiment, a ring is slid over each of the lifting posts before engaging an elevator mechanism about at least a portion of each of the lifting posts. Regardless, in one embodiment, the sliding of the ring over each of the lifting posts occurs before the raising or lowering of the drill pipe by the lifting posts with the elevator mechanism.

Regardless, in one embodiment, a ring is slid over each of the listing posts, and thereafter a rod is provided through and projects outwardly of ends of the hole extending through each of the lifting posts. In one embodiment, such sliding is longitudinally inward on the respective lifting post past the respective hole extending through the respective lifting post.

In one embodiment, the elevator mechanism comprises wire rope, with the engaging comprising wrapping some of the wire rope about half of each of the lifting posts. In one embodiment where the elevator mechanism comprises wire rope, the first and second pieces are held together at least in part by pushing force provided by the wire rope against each projection in the direction of the other of the first and second pieces. For example and by way of example only, the wire rope as received about the projections in FIG. 7 even though in an essential vertical direction does provide lateral clamping force of each separable piece relative to one another upon engagement of the elevator mechanism sufficient to be supported by wire rope 45. The same also occurs with respect to even the embodiments of FIGS. 8 and 9 wherein wire rope 45 provides a degree of inward pushing force of the first and second pieces relative to one another in addition to any force which might be provided by the depicted nut and bolt combinations extending transversely through each projection.

In compliance with the statute, the invention has been described in language more or less specific as to structural and elevatorical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A drill pipe elevator comprising first and second separable pieces, each piece comprising a drill pipe-receiving groove, each piece comprising a pair of diametrically opposed projections with each projection forming only part of one of a pair of diametrically opposed lifting posts, the first and second separable pieces when positioned together defining the pair of diametrically opposed lifting posts from the pair of diametrically opposed projections and defining a drill pipe-receiving passageway through the drill pipe elevator that is oriented transversely between the lifting posts.

2. The drill pipe elevator of claim 1 wherein the first and second separable pieces are identically shaped relative to one another.

3. The drill pipe elevator of claim 1 wherein each projection forms half of one of the pair of lifting posts.

4. The drill pipe elevator of claim 1 wherein each of the pair of lifting posts has a circular periphery in a plane which is transverse a direction in which the respective lifting post projects.

5. The drill pipe elevator of claim 4 wherein each projection has a periphery in a plane transverse a direction in which the respective projection projects which forms half of a circle.

6. The drill pipe elevator of claim 1 wherein each projection comprises a hole extending there-through transverse a direction in which the projection projects, the hole in each of the projections lining up with a hole in another of the projections to define a hole extending through each of the lifting posts when the first and second separable pieces are positioned together.

7. The drill pipe elevator of claim 6 comprising a rod received through and projecting outwardly of ends of the hole extending through each of the lifting posts.

8. The drill pipe elevator of claim 1 comprising a lifting mechanism retainer associated with each lifting post, the lifting mechanism retainer being configured to block movement of a lifting mechanism longitudinally from the respective lifting post.

9. The drill pipe elevator of claim 1 comprising a lifting mechanism retainer associated with each lifting post, the lifting mechanism retainer projecting transverse a direction in which the lifting post projects and being configured to block movement of a lifting mechanism longitudinally from the respective lifting post.

10. The drill pipe elevator of claim 9 wherein the lifting mechanism retainer comprises an annulus received about the respective lifting post.

11. The drill pipe elevator of claim 10 wherein the annulus comprises a ring having an opening therein of sufficient size to enable the annulus to be slid on and off the respective lifting post.

12. The drill pipe elevator of claim 11 wherein the ring is washer-like in shape.

13. The drill pipe elevator of claim 11 wherein the ring comprises a sheave.

14. The drill pipe elevator of claim 9 wherein the lifting mechanism retainer comprises a rod extending through a hole in the respective lifting post.

15. The drill pipe elevator of claim 14 wherein the rod comprises a bolt and nut.

16. The drill pipe elevator of claim 9 wherein the lifting mechanism retainer comprises an annulus that encircles the respective lifting post, the annulus comprising a ring having an opening therein of sufficient size to enable the annulus to be slid on and off the respective lifting post, the lifting mechanism retainer comprising a rod extending through a hole in the respective lifting post, the rod being configured to block movement of the ring longitudinally from being received on the respective lifting post.

17. The drill pipe elevator of claim 1 wherein each of the first and second separable pieces comprises contacting surfaces which contact the contacting surfaces of the other of the first and second piece, all of the contacting surfaces being flat.

18. The drill pipe elevator of claim 17 wherein each piece comprising a main body portion from which each projection projects, the contacting surfaces being received on both the main body portion and each projection.

19. The drill pipe elevator of claim 17 wherein all of the contacting surfaces of each piece lie in a respective common plane.

20. The drill pipe elevator of claim 19 wherein each piece comprising a main body portion from which each projection projects, the contacting surfaces being received on both the main body portion and each projection.

21. The drill pipe elevator of claim 1 wherein the first and second separable pieces are void of any hinged connection relative to one another when positioned together.

22. A drill pipe elevator comprising first and second separable pieces, each piece comprising a drill pipe-receiving groove, each piece comprising a pair of diametrically opposed projections with each projection forming only part of one of a pair of diametrically opposed a lifting posts, the first and second separable pieces when positioned together defining the pair of diametrically opposed lifting posts from the pair of diametrically opposed projections and defining a drill pipe-receiving passageway through the drill pipe elevator that is oriented transversely between the lifting posts, each of the pair of lifting posts having a circular periphery in a plane which is transverse a direction in which the respective lifting post projects with each projection having a periphery in a plane transverse a direction in which the respective projection projects which forms half of a circle, each projection comprising a hole extending there-through transverse a direction in which the projection projects, the hole in each of the projections lining up with a hole in another of the projections to define a hole extending through each of the lifting posts when the first and second separable pieces are positioned together.

23. The drill pipe elevator of claim 22 comprising a lifting mechanism retainer associated with each lifting post, the lifting mechanism retainer projecting transverse a direction in which the lifting post projects and being configured to block movement of a lifting mechanism longitudinally from the respective lifting post.

24. The drill pipe elevator of claim 23 wherein the lifting mechanism retainer comprises an annulus received about the respective lifting post.

25. The drill pipe elevator of claim 24 wherein the annulus comprises a ring having an opening therein of sufficient size to enable the annulus to be slid on and off the respective lifting post.

26. The drill pipe elevator of claim 25 wherein the ring is washer-like in shape.

27. The drill pipe elevator of claim 25 wherein the ring comprises a sheave.

28. The drill pipe elevator of claim 23 wherein the lifting mechanism retainer comprises a rod extending through the hole in the respective lifting post.

29. The drill pipe elevator of claim 23 wherein the lifting mechanism retainer comprises an annulus that encircles the respective lifting post, the annulus comprising a ring having an opening therein of sufficient size to enable the annulus to be slid on and off the respective lifting post, the lifting mechanism retainer comprising a rod extending through the hole in the respective lifting post, the rod being configured to block movement of the ring longitudinally from being received on the respective lifting post.

30. The drill pipe elevator of claim 23 wherein each of the first and second separable pieces comprises contacting surfaces which contact the contacting surfaces of the other of the first and second piece, the contacting surfaces being flat.

31. The drill pipe elevator of claim 30 wherein each piece comprising a main body portion from which each projection projects, the contacting surfaces being received on both the main body portion and each projection.

32. The drill pipe elevator of claim 30 wherein all of the contacting surfaces of each piece lie in a respective common plane.

33. A method of moving drill pipe, comprising:

providing a drill pipe elevator comprising first and second separable pieces, each piece comprising a drill pipe-receiving groove, each piece comprising a pair of diametrically opposed projections with each projection forming only part of a pair of diametrically opposed lifting posts, the first and second separable pieces when positioned together defining the pair of diametrically opposed lifting posts from the pair of diametrically opposed projections and defining a drill pipe-receiving passageway through the drill pipe elevator that is oriented transversely between the lifting posts;

positioning one of the first and second pieces and a drill pipe relative one another such that the drill pipe is received within the drill pipe-receiving groove of the one piece;

during or after the positioning, moving the other of the first and second pieces to position its well-pipe receiving groove facing the drill pipe opposite the one piece to define the pair of diametrically opposed lifting posts;

engaging an elevator mechanism about at least a portion of each of the lifting posts; and raising or lowering the drill pipe by the lifting posts with the elevator mechanism.

34. The method of claim 33 wherein, each projection comprises a hole extending there-through transverse a direction in which the projection projects, the hole in each of the projections lining up with a hole in another of the projections to define a hole extending through each of the lifting posts after the positioning and the moving; and providing a rod through and projecting outwardly of ends of the hole extending through each of the lifting posts.

35. The method of claim 33 comprising sliding a ring over each of the lifting posts after the engaging.

36. The method of claim 35 wherein the sliding occurs before the raising or lowering.

37. The method of claim 33 comprising sliding a ring over each of the lifting posts before the engaging.

38. The method of claim 33 wherein, each projection comprises a hole extending there-through transverse a direction in which the projection projects, the hole in each of the projections lining up with a hole in another of the projections to define a hole extending through each of the lifting posts after the positioning and the moving;

sliding a ring over each of the lifting posts; and after the sliding, providing a rod through and projecting outwardly of ends of the hole extending through each of the lifting posts.

39. The method of claim 38 wherein the sliding is longitudinally inward on the respective lifting post past the respective hole extending through the respective lifting post.

40. The method of claim 33 wherein the elevator mechanism comprises wire rope, the engaging comprising wrapping some of the wire rope about half of each of the lifting posts.

41. The method of claim 33 wherein the elevator mechanism comprises wire rope, the engaging comprising wrapping some of the wire rope about at least some of each of the lifting posts, and holding the first and second pieces together at least in part by pushing force provided by the wire rope against each projection in the direction of the other of the first and second pieces.

* * * * *